US010663215B2

(12) United States Patent
Moertl et al.

(10) Patent No.: US 10,663,215 B2
(45) Date of Patent: May 26, 2020

(54) REFRIGERATING DEVICE WITH AN ICE WATER DISPENSER

(71) Applicant: BSH HAUSGERAETE GMBH, Munich (DE)

(72) Inventors: Florian Moertl, Neu-Ulm (DE); Karl-Friedrich Laible, Langenau (DE); Hans Gerd Keller, Giengen (DE); Senol Temizkan, Aalen (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 16/000,999

(22) Filed: Jun. 6, 2018

(65) Prior Publication Data

US 2018/0356146 A1 Dec. 13, 2018

(30) Foreign Application Priority Data

Jun. 12, 2017 (DE) ..... 10 2017 209 854

(51) Int. Cl.
*F25D 23/12* (2006.01)
*F25D 23/02* (2006.01)
*F25C 5/20* (2018.01)

(52) U.S. Cl.
CPC ..... *F25D 23/028* (2013.01); *F25C 5/22* (2018.01); *F25D 23/126* (2013.01); *F25C 2400/10* (2013.01); *F25D 2400/18* (2013.01); *F25D 2400/22* (2013.01)

(58) Field of Classification Search
CPC .. F25D 23/126; F25D 23/028; F25D 2400/18; F25D 2400/36
See application file for complete search history.

(56) References Cited

U.S. PATENT DOCUMENTS

| | | | | |
|---|---|---|---|---|
| 7,013,667 | B2 † | 3/2006 | Jung | |
| 7,073,876 | B2 † | 7/2006 | Wing | |
| 8,122,734 | B2 † | 2/2012 | Buchstab | |
| 2011/0089790 | A1 * | 4/2011 | Lee | B29C 44/1233 312/109 |
| 2012/0152983 | A1 * | 6/2012 | Savan | F25C 5/22 222/173 |
| 2017/0307274 | A1 * | 10/2017 | Laible | F25D 23/126 |

* cited by examiner
† cited by third party

*Primary Examiner* — David J Teitelbaum
(74) *Attorney, Agent, or Firm* — Laurence A. Greenberg; Werner H. Stemer; Ralph E. Locher

(57) ABSTRACT

A refrigeration appliance contains an ice water dispenser with a housing which is built into a wall or door of the refrigeration appliance and defines a dispenser niche for the introduction of a container for receiving ice and/or water. The ice water dispenser further has a décor panel which defines a rear side of the dispenser niche where the rear side is visible from outside the refrigeration appliance. The ice water dispenser additionally has a retaining element which is arranged in the housing and is configured to engage with the décor panel in such a way that the décor panel is detachably mounted in the housing.

9 Claims, 9 Drawing Sheets

REFRIGERATING DEVICE WITH AN ICE WATER DISPENSER

CROSS-REFERENCE TO RELATED APPLICATION

This application claims the priority, under 35 U.S.C. § 119, of German application DE 10 2017 209 854.6, filed Jun. 12, 2017; the prior application is herewith incorporated by reference in its entirety.

BACKGROUND OF THE INVENTION

Field of the Invention

The present invention relates to a refrigeration appliance with an ice water dispenser. A refrigeration appliance is understood to be in particular a domestic refrigeration appliance, i.e. a refrigeration appliance which is installed for the purpose of housekeeping in a domestic environment or in the catering field and is used in particular to store food and/or drinks at specified temperatures, such as a refrigerator, an upright freezer, a combined fridge-freezer, or a chest freezer, for example.

Numerous designs are known for ice water dispensers (IWD) that are built into a wall or door of a refrigeration appliance in order to deliver ice or cooled water, this being stored or generated inside the refrigeration appliance, without the door having to be opened for this purpose. Since an ice water dispenser is usually mounted at a prominent position of a refrigeration appliance, it determines to a significant extent the overall aesthetic impression of the refrigeration appliance.

An ice water dispenser often contains a housing, which is mounted at an opening in the wall or the door of a refrigeration appliance and defines at least partly a dispenser niche into which a user can introduce e.g. a glass or a beaker in order to obtain ice and/or water by the ice water dispenser. A rear side of such a dispenser niche is usually enameled or defined by a décor panel, which is permanently built into the housing of the ice water dispenser, in order to enhance the overall aesthetic impression of the refrigeration appliance. Where a separate décor panel is provided in the housing, the overall aesthetic impression is influenced to a large extent by the décor panel which, as previously mentioned, is nonetheless permanently built into the housing of the ice water dispenser and therefore cannot be withdrawn from the housing for the purpose of cleaning, for example.

SUMMARY OF THE INVENTION

The object of the present invention is therefore to provide a refrigeration appliance with an improved ice water dispenser, which allows the easy withdrawal of the décor panel from the ice water dispenser, e.g. for cleaning purposes.

The object of the invention is achieved by a refrigeration appliance with an ice water dispenser. The ice water dispenser contains a housing, which is built into a wall or door of the refrigeration appliance and defines a dispenser niche for the introduction of a container for receiving ice and/or water, and a décor panel which defines a rear side of the dispenser niche, the rear side being visible from outside the refrigeration appliance. The ice water dispenser further contains a retaining element which is arranged in the housing and is configured to engage with the décor panel in such a way that the décor panel is detachably mounted in the housing. In an embodiment variant, the décor panel has essentially the shape of a rectangle.

An improved ice water dispenser is provided thereby, allowing easy withdrawal of the décor panel for cleaning purposes, for example. A refrigeration appliance is understood to be in particular a domestic refrigeration appliance, i.e. a refrigeration appliance which is installed for the purpose of housekeeping in a domestic environment or in the catering field and is used in particular to store food and/or drinks at specified temperatures, such as a refrigerator, an upright freezer, a combined fridge-freezer, or a chest freezer, for example.

In the case of an ice water dispenser according to the invention, the décor panel can easily be withdrawn by a user and replaced if applicable. It is therefore feasible, for example, for a user to adapt the design of the décor panel to the design of a kitchen, by using a décor panel having the same pattern as a worktop of the kitchen. A further advantage of the option of being able to withdraw the décor panel in a simple manner is the ease of cleaning of the ice water dispenser. If liquids or dirt accumulate behind the décor panel, they can easily be removed when the décor panel is withdrawn.

In an advantageous embodiment variant of the ice water dispenser, the retaining element is configured as a ceiling element which is arranged in the housing, defining at least partly a ceiling section of the dispenser niche, and is configured to engage with an upper edge of the décor panel in such a way that the décor panel is detachably mounted in the housing. This has the advantage that, for example, the décor panel is held in the housing in a stable manner at its upper edge.

In a further advantageous embodiment variant of the refrigeration appliance, the refrigeration appliance contains a further retaining element, which is arranged and configured to engage with a lower edge of the décor panel in such a way that the décor panel is detachably arranged in the housing. This has the advantage that, for example, the décor panel is held in the housing in a stable manner at its lower edge.

In a further advantageous embodiment variant of the refrigeration appliance, a rearward section of the further retaining element defines a key-like recess, which is configured to receive the lower edge of the décor panel. This has the advantage that, for example, the décor panel is held in the housing in a stable manner by the key-like recess.

In a further advantageous embodiment variant of the refrigeration appliance, the retaining element, in particular the ceiling element, has at least one pretensioning element which is designed to engage with the décor panel in such a way that the décor panel is pretensioned in the direction of the further retaining element. This has the advantage that, for example, the décor panel is held in the housing in a stable manner as a result of the pretensioning of the décor panel in the direction of the further retaining element.

In a further advantageous embodiment variant of the refrigeration appliance, the pretensioning element contains a spring element. However, the pretensioning element can also be configured in the form of a wedge, a rib and/or a resilient foamed element. This has the advantage that, for example, the pretensioning element can be provided in the ceiling element at relatively little expense.

In a further advantageous embodiment variant of the refrigeration appliance, the ice water dispenser further contains a detachable drip shelf, wherein a forward section of the further retaining element is arranged between a bottom section of the housing and the drip shelf. This has the advantage that the position of the further retaining element is further stabilized by the drip shelf and a user only needs to lift the drip shelf in order to access the further retaining element.

In a further advantageous embodiment variant of the refrigeration appliance, the forward section of the further retaining element engages positively with the bottom section of the housing. For example, the forward section of the further retaining element can be slotted into the bottom section of the housing. This has the advantage that, for example, the décor panel cannot fall out even after the drip shelf has been withdrawn.

In a further advantageous embodiment variant of the refrigeration appliance, an underside of the further retaining element is provided with a non-slip coating, such that the underside of the further retaining element is frictionally connected to the bottom section of the housing. This has the advantage that, for example, the décor panel cannot fall out even after the drip shelf has been withdrawn.

In a further advantageous embodiment variant of the refrigeration appliance, the décor panel at least partly conceals a rear section of the housing. Alternatively, the décor panel can conceal a section of the door of the refrigeration appliance. This has the advantage that, for example, the overall aesthetic impression of the ice water dispenser is improved.

When reading the claim language, the following definitions apply. When the claim language recites A and/or B it means A alone, B alone or A and B. When the claim language recites at least one of A and B it means A alone, B alone or A and B. When the claim language recites at least one of A or B it means A alone, B alone or A and B. When the claim language recites a form-locking connection (form-lockingly), it is a connection that connects two elements together due to the shape of the elements themselves (e.g. ball and socket), as opposed to a force-locking connection, which locks the elements together by force external to the elements (e.g. screw).

Other features which are considered as characteristic for the invention are set forth in the appended claims.

Although the invention is illustrated and described herein as embodied in a refrigerating device with an ice water dispenser, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
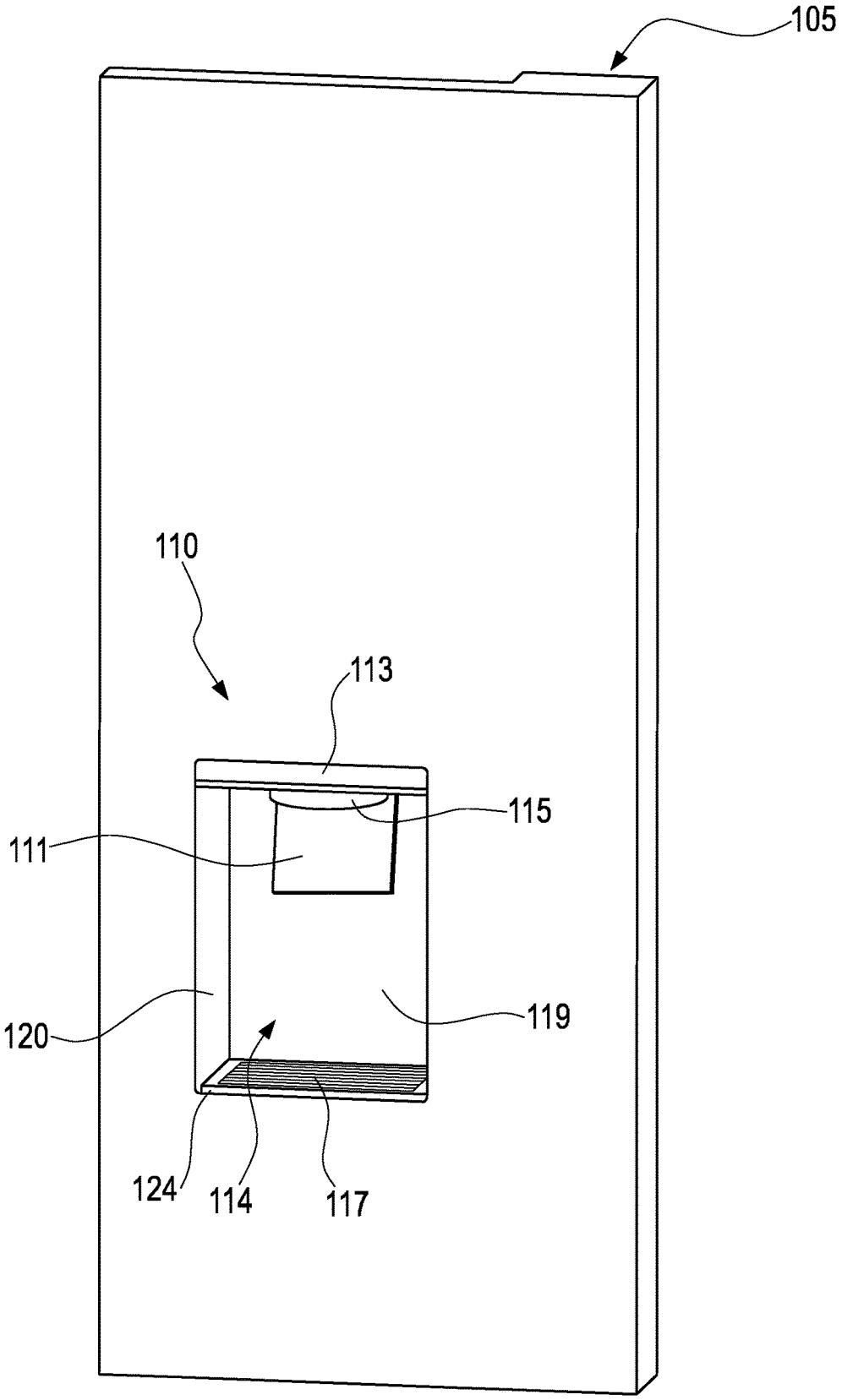
FIG. 1 is a diagrammatic, perspective view of a door of a refrigeration appliance with an ice water dispenser according to an embodiment variant of the invention.

Referring now to the figures of the drawings in detail and first, particularly to FIG. 1 thereof, there is shown a door 105 of a refrigeration appliance, into which is built an ice water dispenser 110 according to an embodiment variant. However, the ice water dispenser 110 can also be built into a wall of the refrigeration appliance.

The refrigeration appliance can be e.g. a combined fridge-freezer which, in addition to the door 105, has a refrigeration appliance body on which the door 105 is mounted in order to allow closure of an opening of a refrigeration zone of a refrigeration appliance interior (alternatively referred to simply as refrigeration zone) that is defined by a refrigeration appliance body 6. The refrigeration appliance body defines a refrigeration appliance outer wall and a refrigeration zone wall. The refrigeration zone wall contains a wall upper side, a wall rear side, a first wall longitudinal side, a second wall longitudinal side and a wall lower side, the wall sides delimiting the refrigeration zone of the refrigeration appliance.

The refrigeration appliance can in a known manner contains one or more refrigerant circuits, each of which has a refrigerant evaporator, refrigerant compressor, refrigerant condenser and/or throttle organ. The refrigerant evaporator is a heat exchanger in which the liquid refrigerant is evaporated after expansion by absorbing heat from the medium to be cooled (e.g. air). The refrigerant compressor is a mechanically operated component which sucks refrigerant vapor from the refrigerant evaporator and outputs it at a higher pressure to the refrigerant condenser.

The refrigeration appliance can be designed to generate ice and/or iced water and deliver this via the ice water dispenser 110. The refrigeration appliance can have a water tank for this purpose, the water tank being accommodated in the interior of the refrigeration appliance or in a heat-insulating wall of the refrigeration appliance, for example. An ice delivery mechanism and optionally a crushing unit are components of automatic ice maker which is already known and therefore not described in detail here, and which can be arranged in the interior of the refrigeration appliance.

As illustrated in FIG. 1, the ice water dispenser 110 defines a dispenser niche 114 in the appliance door 105, in which a user can place a glass, beaker or similar container in order to obtain ice and/or cooled water, e.g. in the form of crushed ice. For this purpose, the ice water dispenser 110 in a known manner contains an output opening 115 for the ice or the cooled water, the output opening 115 being formed at the ceiling of the dispenser niche 114, and an actuating element 111 in the form of an actuating paddle. In a known manner, a user can activate the ice water dispenser 110 by pressing a glass, beaker or similar container against the actuating paddle 111. In order to allow the user to select cooled water and/or ice, the ice water dispenser 110 in the embodiment variant illustrated in FIG. 1 also has a control panel 113, which is connected in a known manner to a control unit of the refrigeration appliance. The control panel 113 allows a user to select an operating mode of the ice water dispenser 110. Depending on the selected operating mode, the control unit can trigger a valve in a water feed line and/or an ice transport mechanism, possibly in conjunction with a crushing unit.

The ice water dispenser 110 further contains a housing 120, which defines at least the side walls of the dispenser niche 114, and a cover 117 of a drip shelf 124, which defines the bottom section of the dispenser niche 114. The rear side of the dispenser niche 114 is defined by a décor panel 119, which is arranged in the housing 120 in such a way that it can be removed as described in detail below.

Figure 2:
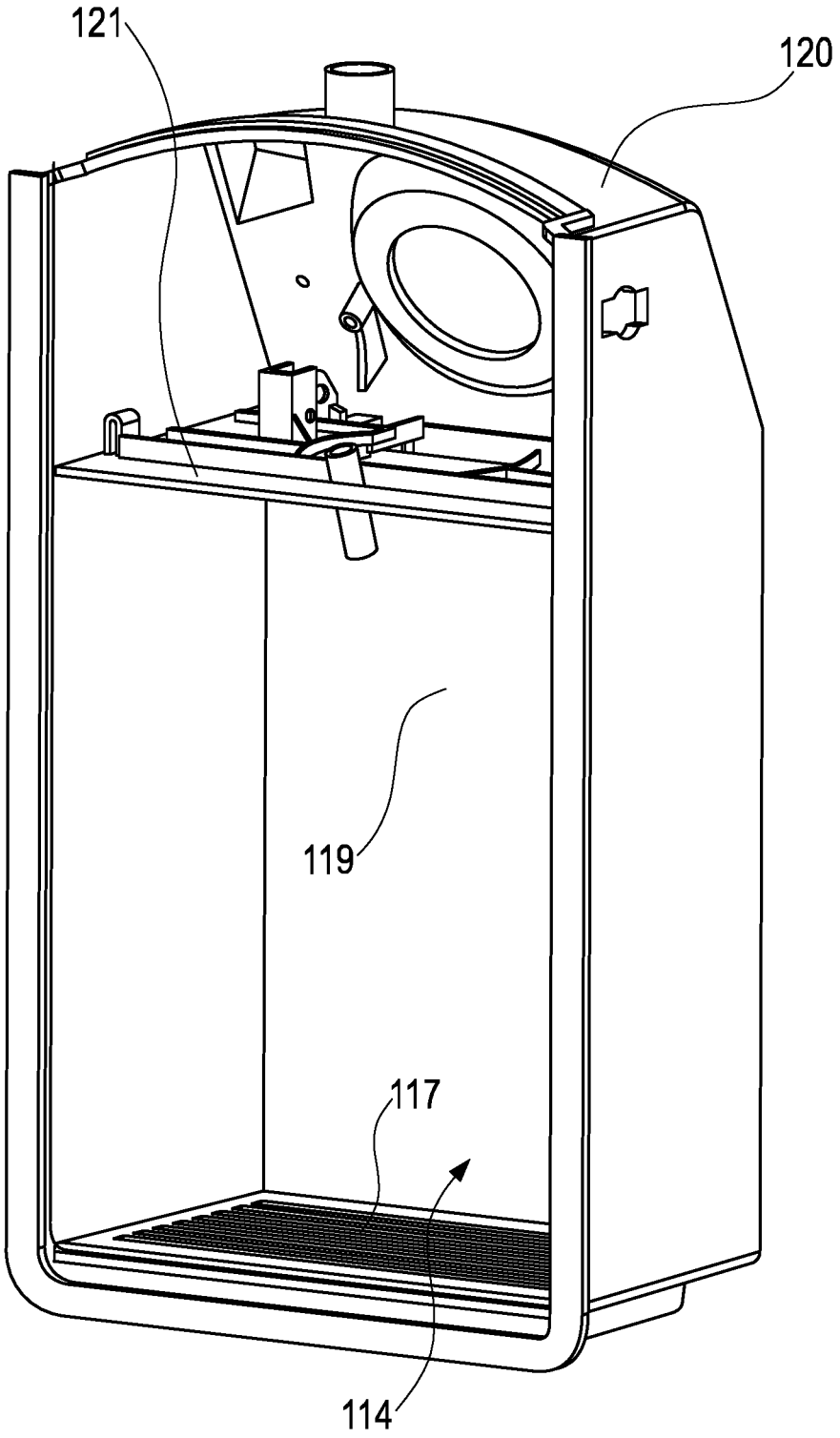
FIG. 2 is a perspective view of a housing of the ice water dispenser according to an embodiment variant.
Figure 3A:
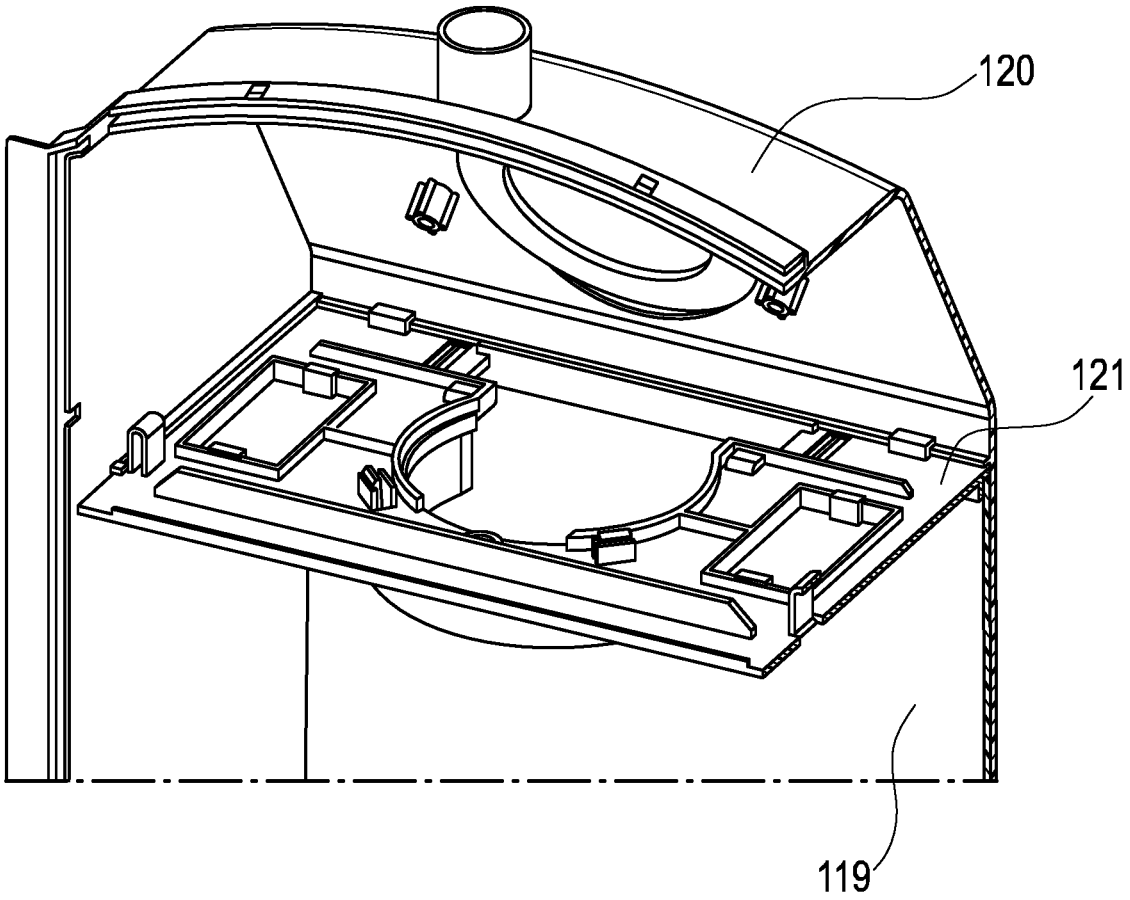
FIG. 3A is a perspective, detail view of an upper region of the housing of the ice water dispenser according to an embodiment variant.
Figure 3B:
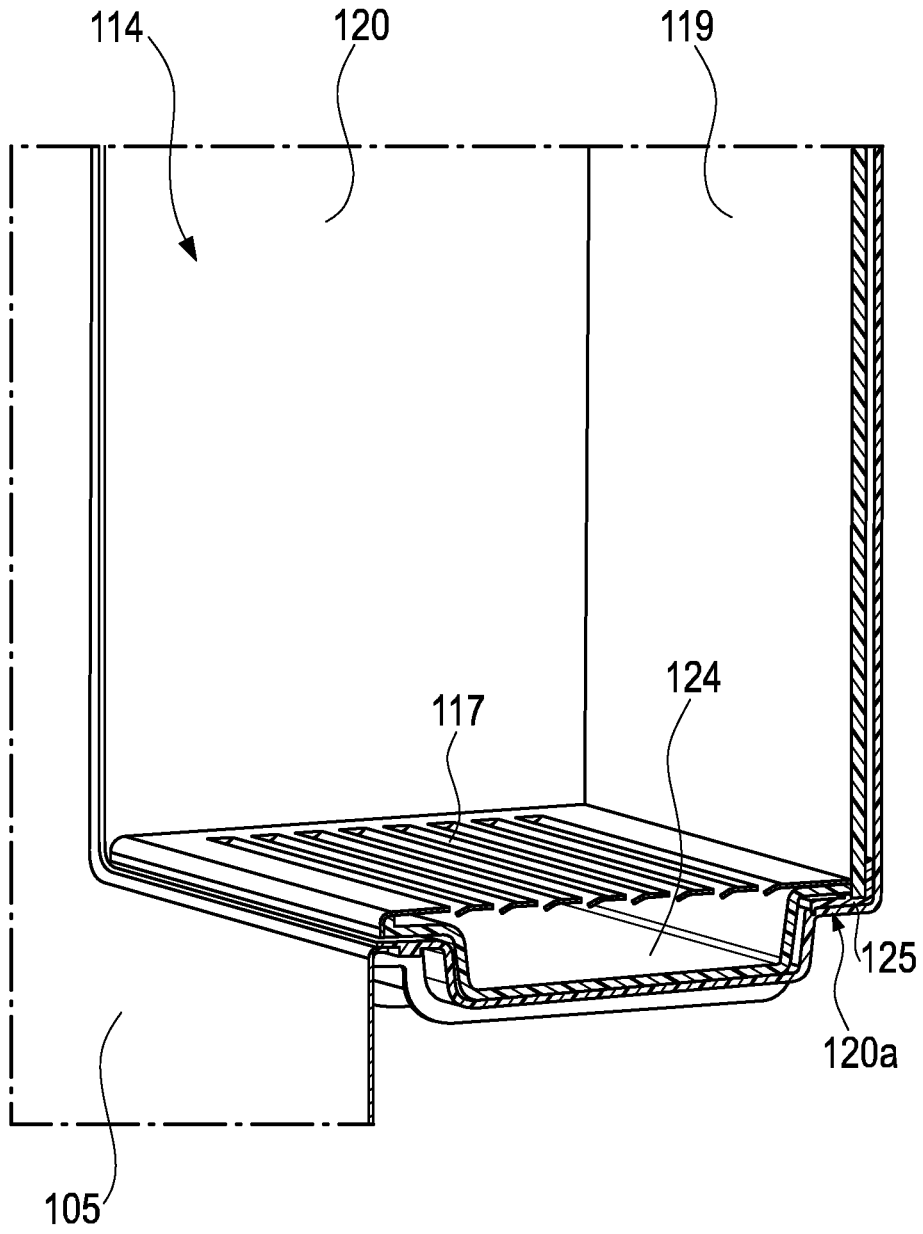
FIG. 3B is a perspective, detail view of a lower region of the housing of the ice water dispenser according to an embodiment variant.

FIG. 2 shows a perspective overall view of the housing 120 of the ice water dispenser 110. FIGS. 3A and 3B respectively show perspective detail views of the upper and lower regions of the housing 120 of the ice water dispenser 110. The ice water dispenser 110 contains a ceiling element 121 which is so configured and arranged in the housing 120 as to define at least partly the ceiling section of the dispenser niche 114. The ceiling element 121 is also referred to as "middle deck". The housing 120 can be an injection molded housing containing a single part or multiple parts and made of plastics material.

Figure 4A:
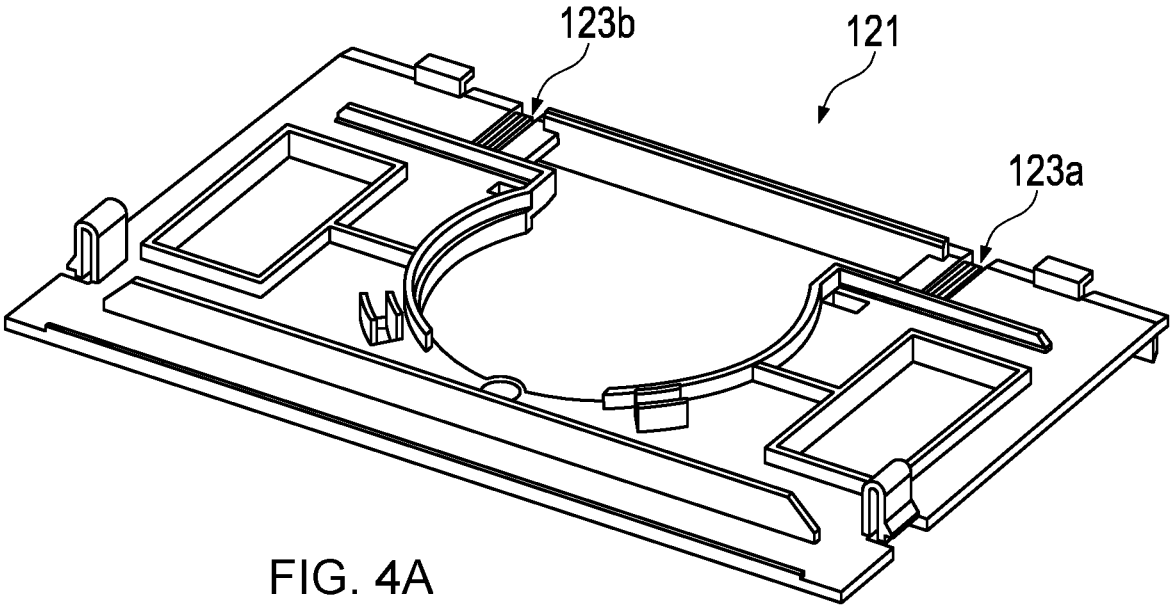
FIG. 4A is a perspective, detail view of a ceiling element of the ice water dispenser according to an embodiment variant.
Figure 4B:
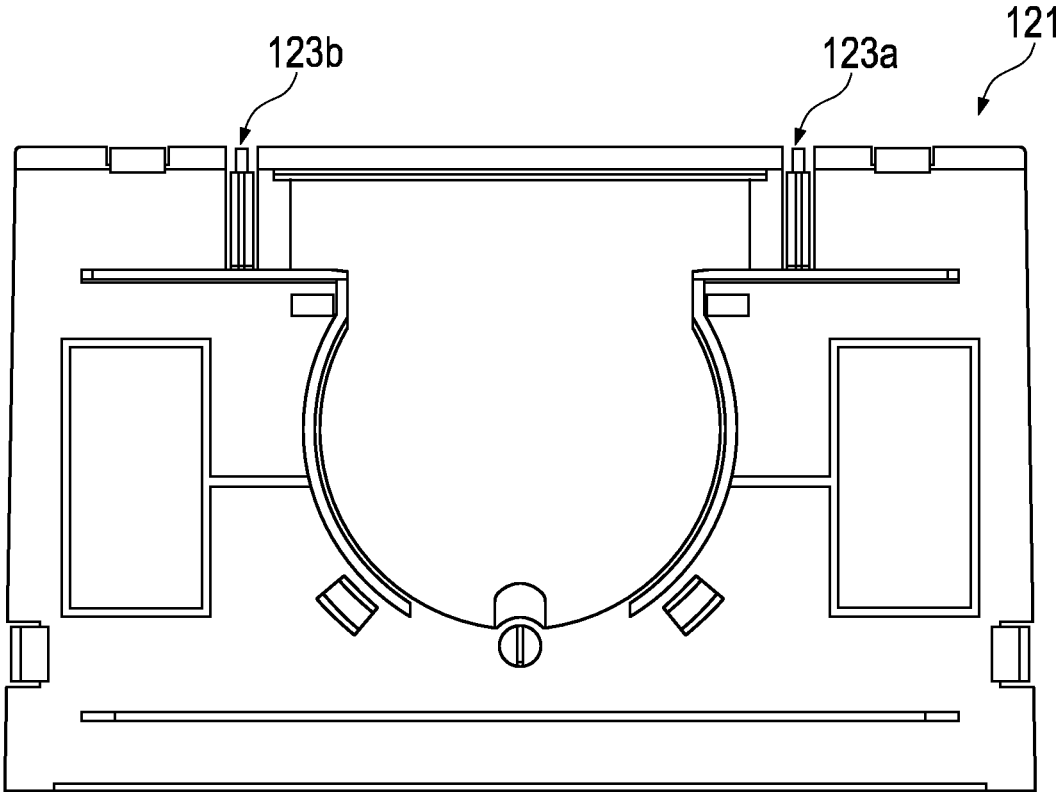
FIG. 4B is a plan view of a detail of the ceiling element of the ice water dispenser according to an embodiment variant.
Figure 5A:
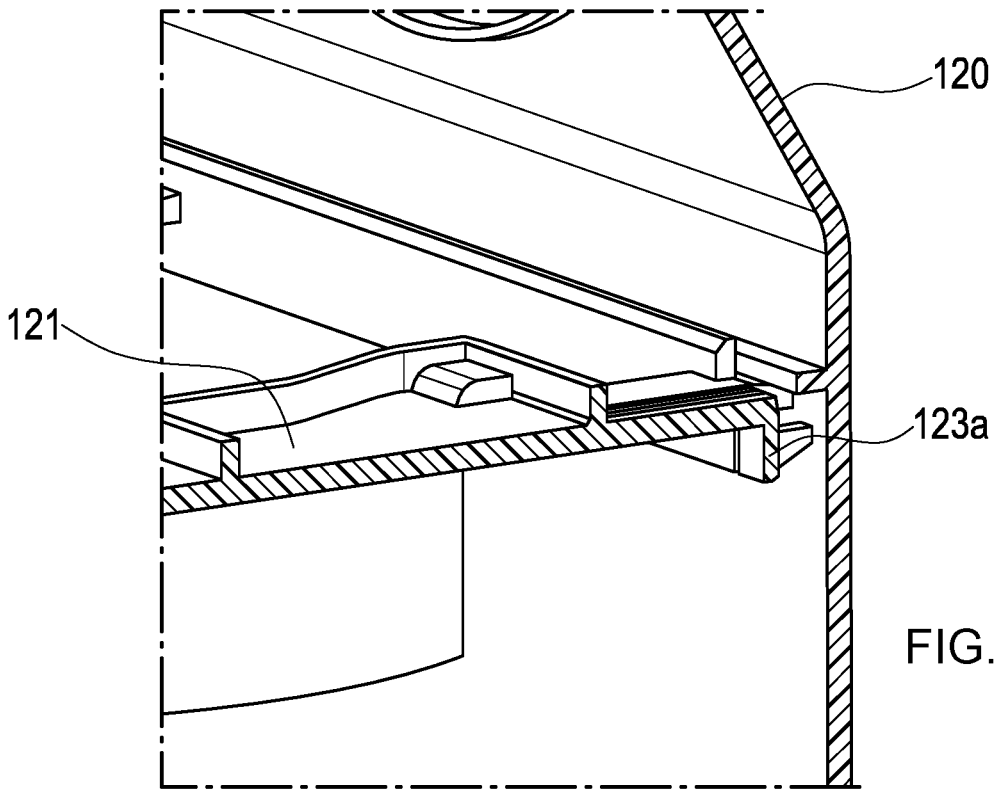
FIG. 5A is a perspective, detail view of an upper region of the ice water dispenser according to an embodiment variant without a décor panel.
Figure 5B:
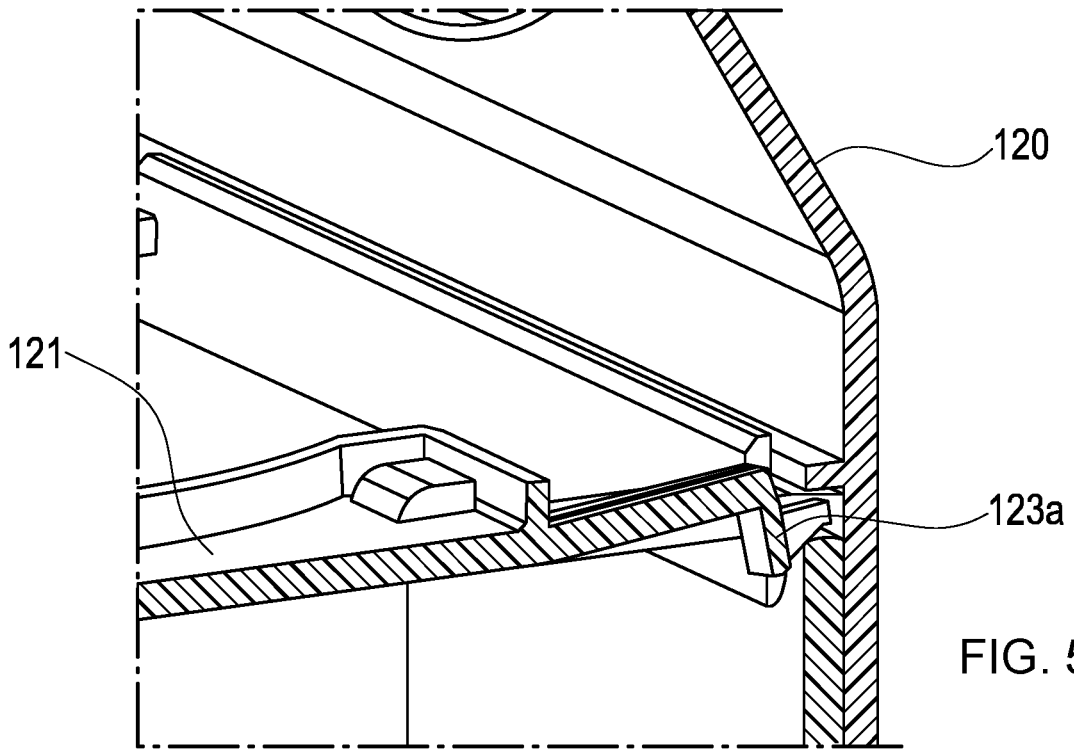
FIG. 5B is a perspective detail view of the upper region of the ice water dispenser according to an embodiment variant with a décor panel installed.

FIGS. 4A and 4B show detail views of the ceiling element 121 of the ice water dispenser 110, specifically a perspective view and a view essentially from above. It can be seen from FIGS. 4A and 4B that the ceiling element 121 has pretensioning elements 123*a*, 123*b* in the form of spring elements 123*a*, 123*b* at the rear side thereof. The operation of the spring elements 123*a*, 123*b* is described below with additional reference to FIGS. 5A and 5B, which show perspective detail views of the upper region of the ice water dispenser 110 with the ceiling element 121 fastened in the housing 120. In this case, FIG. 5A shows the upper region of the ice water dispenser 110 when the décor panel 119 is withdrawn, while FIG. 5B shows the upper region of the ice water dispenser 110 when the décor panel 119 is installed. It can be seen from FIGS. 5A and 5B that the spring elements 123*a*, 123*b* are deflected resiliently from their starting position (see FIG. 5A) upwards (FIG. 5B) by the décor panel 119 and consequently exert a pretension or return force on the décor panel 119. This function can also be provided by pretensioning elements 123*a*, 123*b* in the form of wedges, ribs and/or resilient foamed elements, for example. The ceiling element 121 therefore defines a retaining element which is designed to engage with the décor panel 119 in such a way that the décor panel 119 is detachably mounted in the housing 120, this being advantageous for the cleaning of the ice water dispenser 110 in particular.

As described above, the décor panel 119 defines a rear side of the dispenser niche 114, the rear side being visible from outside the refrigeration appliance. As described below, particularly in connection with FIGS. 6 to 9, the ice water dispenser 110 also contains a further retaining element 125 which is arranged in the housing 120 and is so configured as to engage with a lower edge of the décor panel 119. In order to achieve this, a rearward section 125*a* of the further retaining element 125 can define a key-like recess, which is configured to receive the lower edge of the décor panel 119 in the form of a groove. By virtue of the previously described function of the pretensioning elements 123*a*, 123*b* of the ceiling element 121, the décor panel 119 is pretensioned in the direction of the further retaining element 125 in accordance with an embodiment variant.

Figure 6:
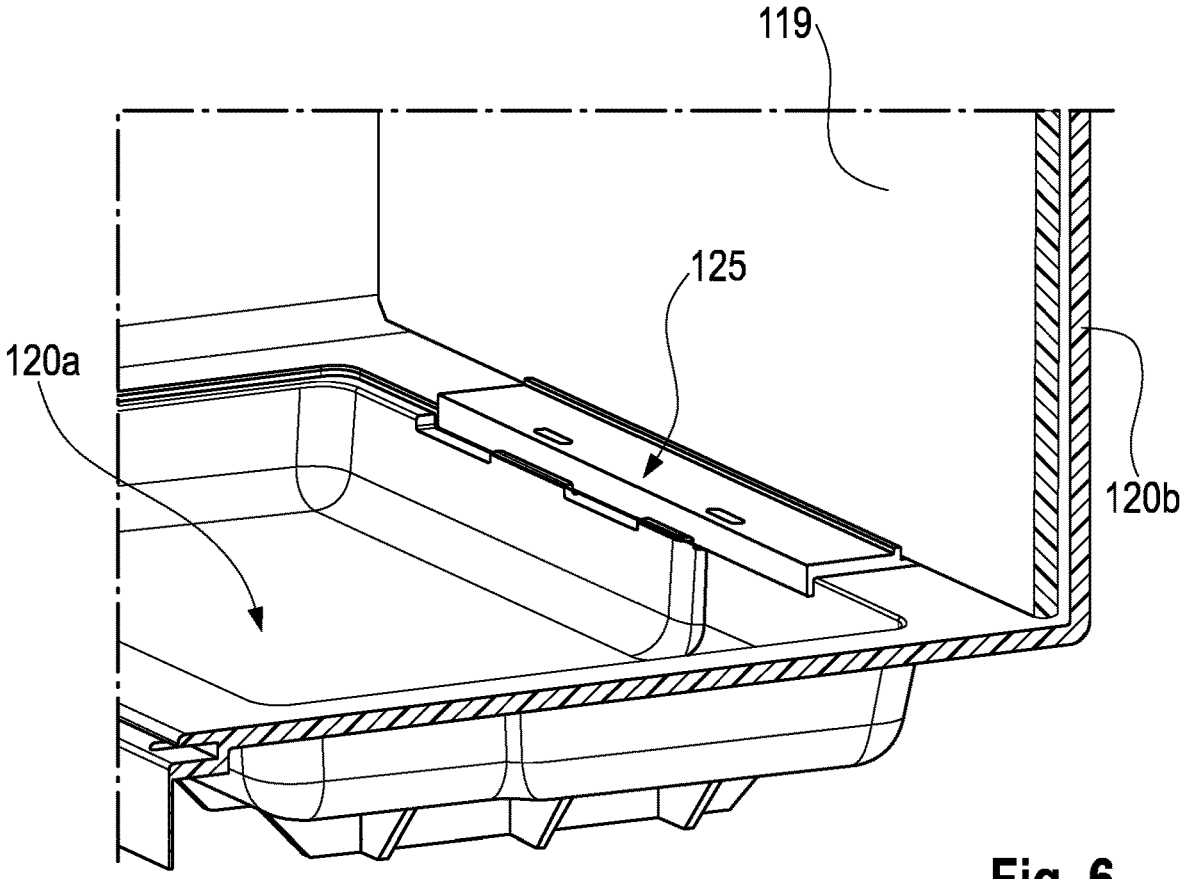
FIG. 6 is a perspective, detail view of a lower region of the ice water dispenser according to an embodiment variant.
Figure 7:
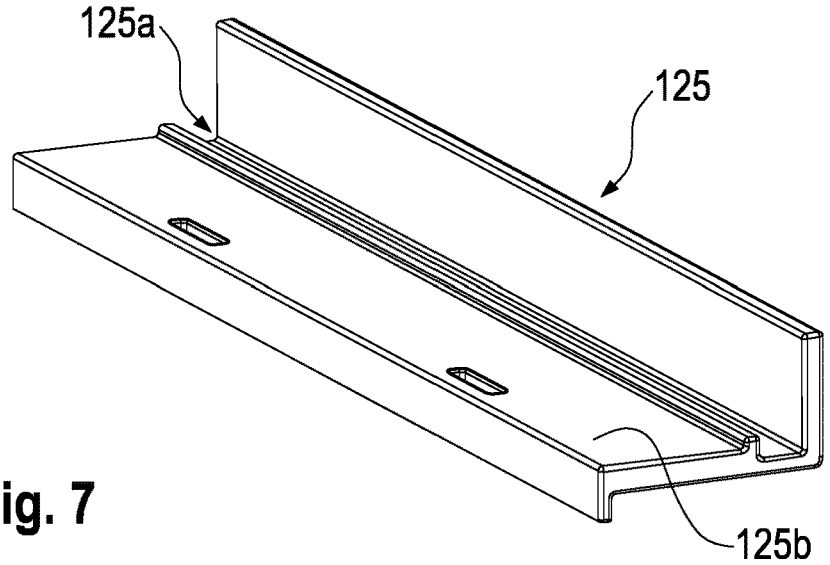
FIG. 7 is a perspective, detail view of a retaining element for holding the décor panel of the ice water dispenser according to an embodiment variant.
Figure 8:
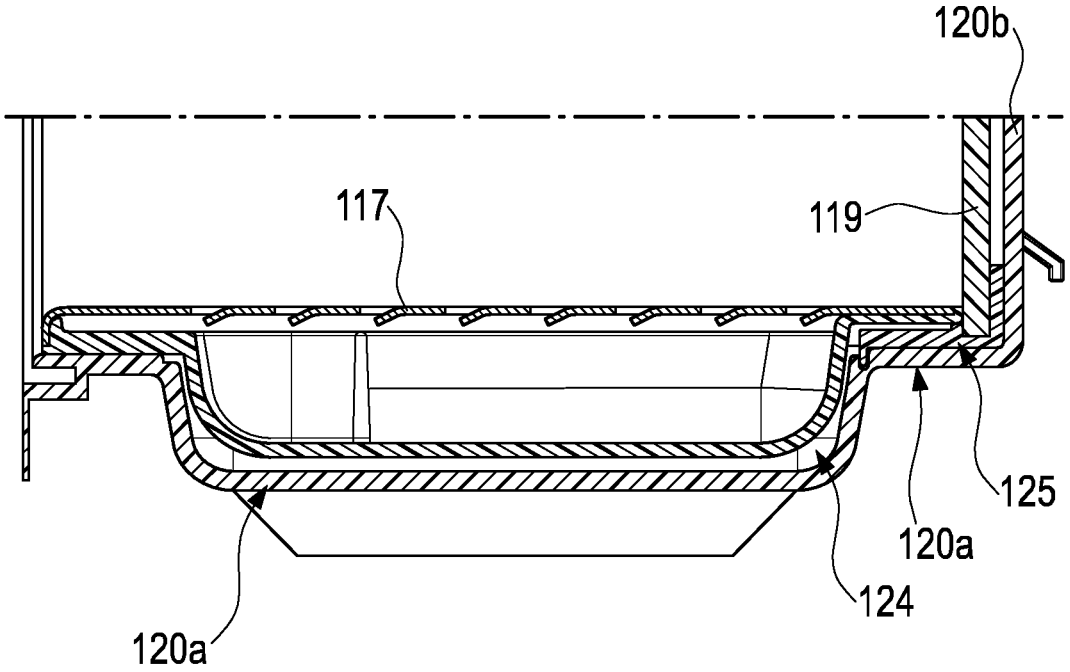
FIG. 8 is a cross-sectional view of the lower region of the ice water dispenser according to an embodiment variant in cross section.
Figure 9:
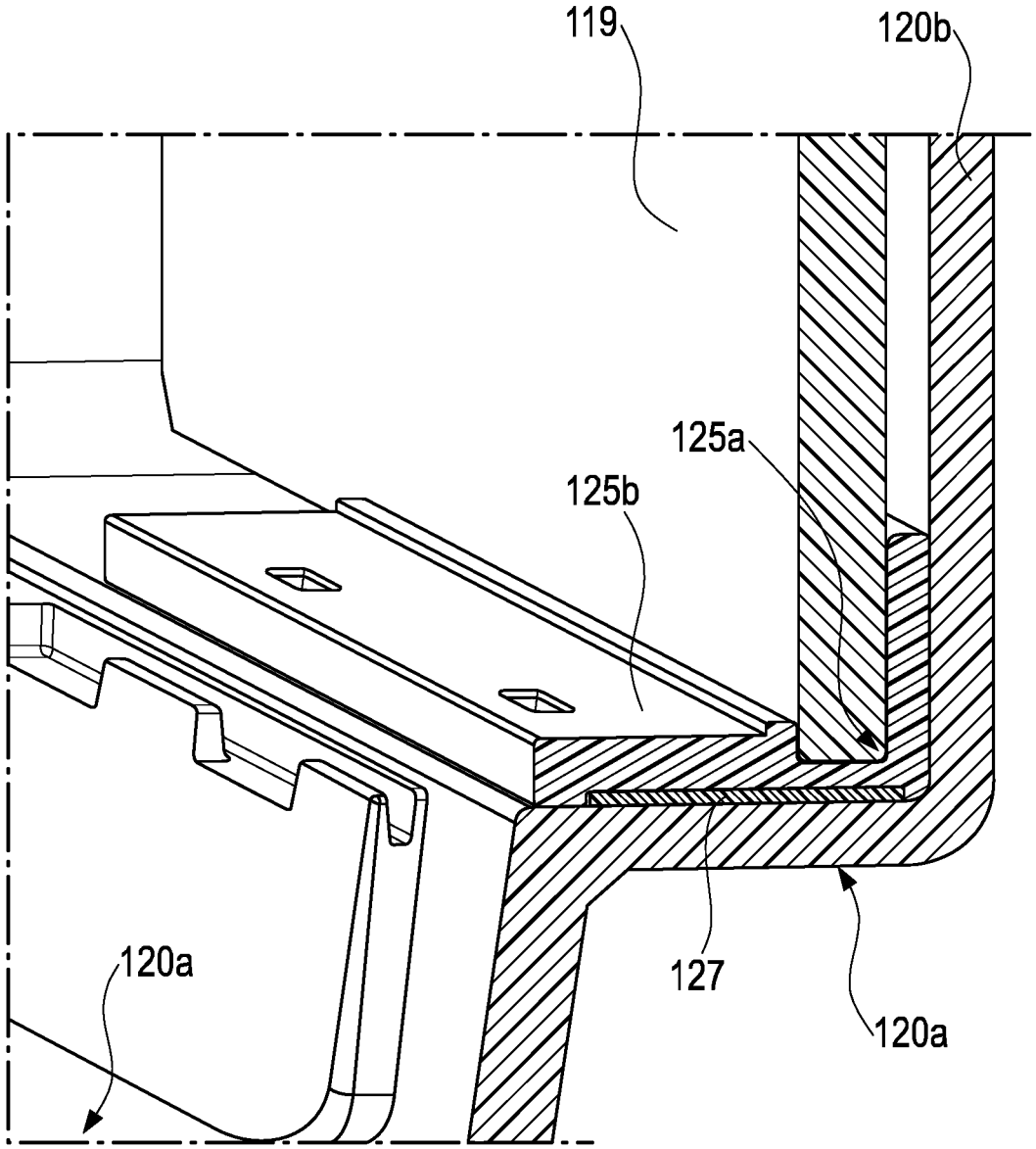
FIG. 9 is a perspective, detail view of the lower region of the ice water dispenser according to an embodiment variant.

In addition to the rearward section 125*a*, the further retaining element 125 can also have a forward section 125*b* as illustrated in FIG. 7, for example. In this case, the forward section 125*b* of the further retaining element 125 can be arranged between a bottom section 120*a* of the housing 120 and the drip shelf 124 (see FIG. 8). The forward section 125*a* of the further retaining element 125 can engage positively with the bottom section 120*a* of the housing 120. For example, the forward section 125*b* of the further retaining element 125 can be slotted into the bottom section 120*a* of the housing 120 as illustrated in FIGS. 6 and 8. Alternatively or additionally, an underside of the further retaining element 125 can be provided with a non-slip coating 127, such that the underside of the further retaining element 125 is frictionally connected to the bottom section 120*a* of the housing 120. In further alternative embodiment variants, the fixing of the further retaining element to the housing 120 can be achieved by means of Velcro strips, magnets, snap-in hooks, screw connections and/or push-push fasteners.

In order to withdraw the décor panel 119 from the housing 120, a user merely has to first lift the drip shelf 124 together with the cover 117, whereby the further retaining element 125 becomes visible to the user. The user can then free the further retaining element 125 together with the décor panel 119. To this end, the user can free the further retaining element 125 from the bottom section 120*a* of the housing 120 and/or push the décor panel further in the direction of the pretensioning elements 123*a,b* of the ceiling element 121, in order to be able to free the décor panel 119 from the further retaining element 125.

According to embodiment variants, the décor panel 119 can consist of metal such as stainless steel, copper or aluminum, for example. The décor panel 119 can also consist of glass or ceramic and may be printed, engraved and/or laser marked. The décor panel 119 may be printed with a photograph or designed to receive a photograph. In an embodiment variant, the décor panel 119 at least partly conceals a rear section 120*b* of the housing 120. Alternatively, the décor panel 119 may conceal a section of the door 105 of the refrigeration appliance in the event that the housing 120 has no rear section 120*b*.

Any of the features explained and illustrated in connection with individual embodiment variants of the invention may be variously combined in the inventive subject matter in order concurrently to realize their advantageous effects.

The scope of the present invention is established by the claims and is not restricted by the features explained in the description or shown in the figures.

The following is a summary list of reference numerals and the corresponding structure used in the above description of the invention:

105 Refrigeration appliance door
110 Ice water dispenser
111 Actuating element
113 Control panel
114 Dispenser niche

115 Output opening
117 Cover
119 Décor panel
120 Housing
120*a* Bottom section
120*b* Rear section
121 Ceiling element
123*a, b* Spring elements
124 Drip shelf
125 Further retaining element
125*a* Rearward section
125*b* Forward section
127 Non-slip coating

The invention claimed is:

1. A refrigeration appliance, comprising:

a door;

a wall;

an ice water dispenser containing a housing being built into said wall or said door and defining a dispenser niche for an introduction of a container for receiving ice and/or water, and a décor panel defining a rear side of said dispenser niche, said rear side being visible from outside the refrigeration appliance, said ice water dispenser further containing a ceiling retainer disposed in said housing and configured to engage with said décor panel such that said décor panel is detachably mounted in said housing;

said ceiling retainer at least partly defining a ceiling section of said dispenser niche and configured to engage with an upper edge of said décor panel in such a way that said décor panel is detachably mounted in said housing;

a further retainer configured to engage with a lower edge of said décor panel in such a way that said décor panel is detachably mounted in said housing, said further retainer having a rearward section with a recess formed therein and said recess running a full length of said further retainer, said recess receiving said lower edge of said décor panel and disposed at said rear side of said dispenser niche; and said ceiling retainer having at least one pretensioning element configured to pretension said décor panel in a direction of said further retainer.

2. The refrigeration appliance according to claim 1, wherein said décor panel is planar in shape.

3. The refrigeration appliance according to claim 1, wherein said pretensioning element has a spring element.

4. The refrigeration appliance according to claim 1, wherein:

said ice water dispenser has a detachable drip shelf; and said further retainer has a forward section disposed between a bottom section of said housing and said drip shelf.

5. The refrigeration appliance according to claim 4, wherein said forward section of said further retainer engages form-lockingly with said bottom section of said housing.

6. The refrigeration appliance according to claim 1, wherein said décor panel at least partly conceals a rear section of said housing.

7. The refrigeration appliance according to claim 1, wherein:

said dispenser niche has a front side adjacent to a front said of said door; and said ceiling retainer extending from said rear side of said dispenser niche to said front side of said dispenser niche.

8. The refrigeration appliance according to claim 1, wherein said ceiling retainer has a passageway for guiding a fluid.

9. A refrigeration appliance, comprising:

a door;

a wall;

an ice water dispenser containing a housing being built into said wall or said door and defining a dispenser niche for an introduction of a container for receiving ice and/or water, and a décor panel defining a rear side of said dispenser niche, said rear side being visible from outside the refrigeration appliance, said ice water dispenser further containing a ceiling retainer disposed in said housing and configured to engage with said décor panel such that said décor panel is detachably mounted in said housing, said housing having a bottom section;

said ceiling retainer at least partly defining a ceiling section of said dispenser niche and configured to engage with an upper edge of said décor panel in such a way that said décor panel is detachably mounted in said housing;

a further retainer configured to engage with a lower edge of said décor panel in such a way that said décor panel is detachably mounted in said housing, said further retainer having an underside with a non-slip coating, such that said underside of said further retainer is frictionally connected to said bottom section of said housing; and said ceiling retainer having at least one pretensioning element configured to pretension said décor panel in a direction of said further retainer.

* * * * *